US009233397B1

(12) United States Patent
Johnson

(10) Patent No.: US 9,233,397 B1
(45) Date of Patent: Jan. 12, 2016

(54) SEED FILTERING SYSTEM

(71) Applicant: S & S Seed LLP, Page, ND (US)

(72) Inventor: Steven B. Johnson, Page, ND (US)

(73) Assignee: S & S Seed LLP, Page, ND (US)

( * ) Notice: Subject to any disclaimer, the term of this patent is extended or adjusted under 35 U.S.C. 154(b) by 0 days.

(21) Appl. No.: 14/596,430

(22) Filed: Jan. 14, 2015

(51) Int. Cl.
*B07B 13/00* (2006.01)
*B07C 5/12* (2006.01)
*B07B 1/04* (2006.01)

(52) U.S. Cl.
CPC ..... *B07B 1/04* (2013.01)

(58) Field of Classification Search
CPC ..... B07B 1/02; B07B 1/04
USPC ..... 209/236, 417, 680
See application file for complete search history.

(56) References Cited

U.S. PATENT DOCUMENTS 1,343,078 A * 6/1920 Carter ..... B04B 3/00 210/297
1,593,447 A * 7/1926 Friedman ..... F24B 15/007 209/348
2,075,097 A * 3/1937 Power ..... B07B 1/30 160/380
4,222,866 A * 9/1980 Wilson ..... A24F 19/00 209/257
4,572,782 A 2/1986 Smith
4,718,578 A 1/1988 Radek
5,082,555 A * 1/1992 Read ..... B07B 1/46 209/244
5,406,777 A 4/1995 Porto
5,752,367 A 5/1998 VerMehren
5,792,356 A * 8/1998 Yuan ..... 210/473
5,927,356 A 7/1999 Henderson
6,269,849 B1 8/2001 Fields, Jr.
6,662,528 B2 12/2003 Holt
7,588,217 B1 9/2009 Rooker
8,567,456 B1 * 10/2013 Francis ..... B67C 11/02 141/286
8,714,211 B1 5/2014 Schaefer
2004/0016378 A1 1/2004 Powell
2008/0087580 A1 * 4/2008 Coen ..... B07B 1/4663 209/312
2008/0110133 A1 5/2008 Lorenzi
2010/0101071 A1 4/2010 Wendte

* cited by examiner

*Primary Examiner* — Terrell Matthews
(74) *Attorney, Agent, or Firm* — Neustel Law Offices

(57) ABSTRACT

A seed filtering system for funneling and filtering material. The seed filtering system generally includes an opening for receiving material entering into the funneling device. A primary side wall, wherein all of the material entering the funneling device is funneled onto the primary side wall. A filter disposed on the primary side wall for filtering the material that is funneled onto the primary side wall. A discharge hole for discharging the material that is filtered through the funneling device.

17 Claims, 11 Drawing Sheets

SEED FILTERING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a funneling and filtering device and more specifically it relates to a seed filtering system for funneling and filtering seed passing through the device.

2. Description of the Related Art

Any discussion of the related art throughout the specification should in no way be considered as an admission that such related art is widely known or forms part of common general knowledge in the field.

Material may spill when transferred from a first container to a second container. The spilled material may be wasted which results in additional costs.

Additionally, the material may include unwanted debris. It may be undesirable store the material with the unwanted debris.

Because of the inherent problems with the related art, there is a need for a new and improved seed filtering system for funneling and filtering seed passing through the device.

BRIEF SUMMARY OF THE INVENTION

The invention generally relates to a funneling/filtering device which includes an opening for receiving material entering into the funneling device. The device also includes a primary side wall, wherein all of the material entering the funneling device is funneled onto the primary side wall; a filter disposed on the primary side wall for filtering the material that is funneled onto the primary side wall; and a discharge hole for discharging the material that is filtered through the funneling device.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
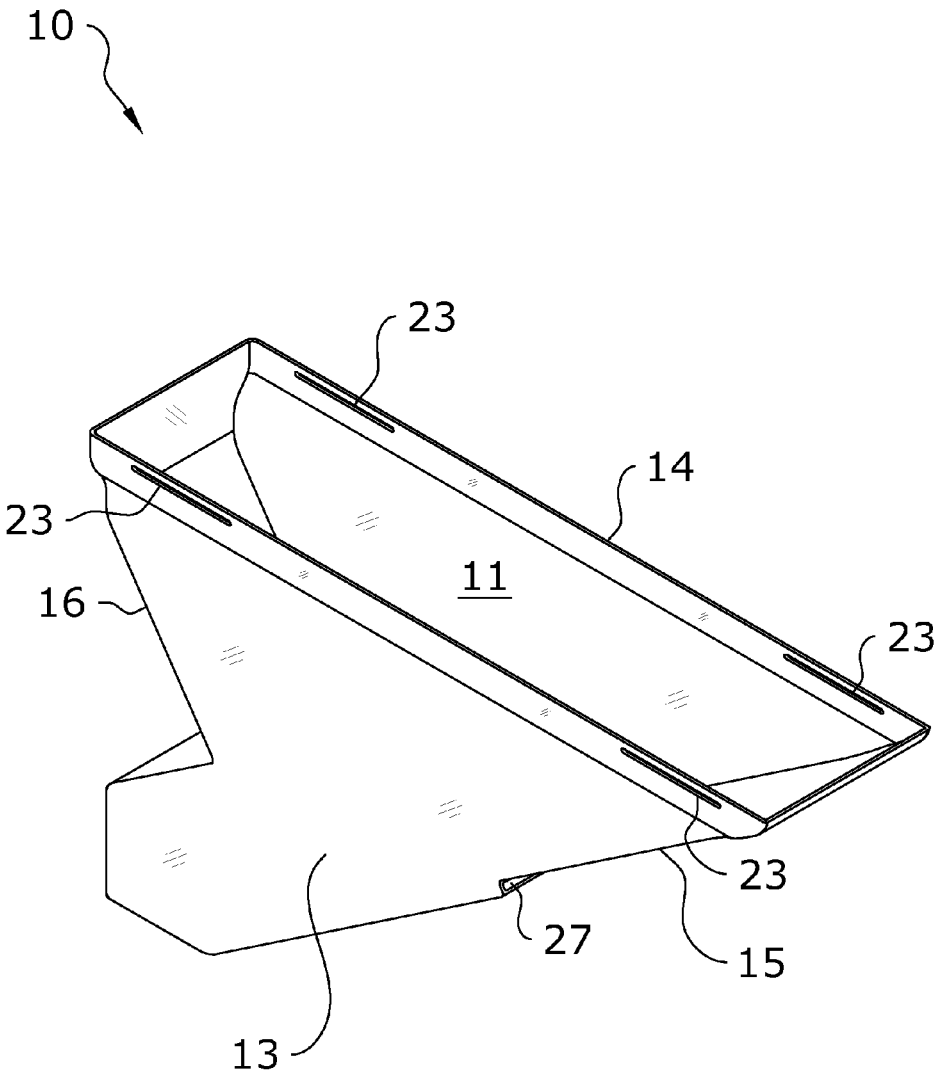
FIG. 1 is an upper perspective view of the present invention.
Figure 2:
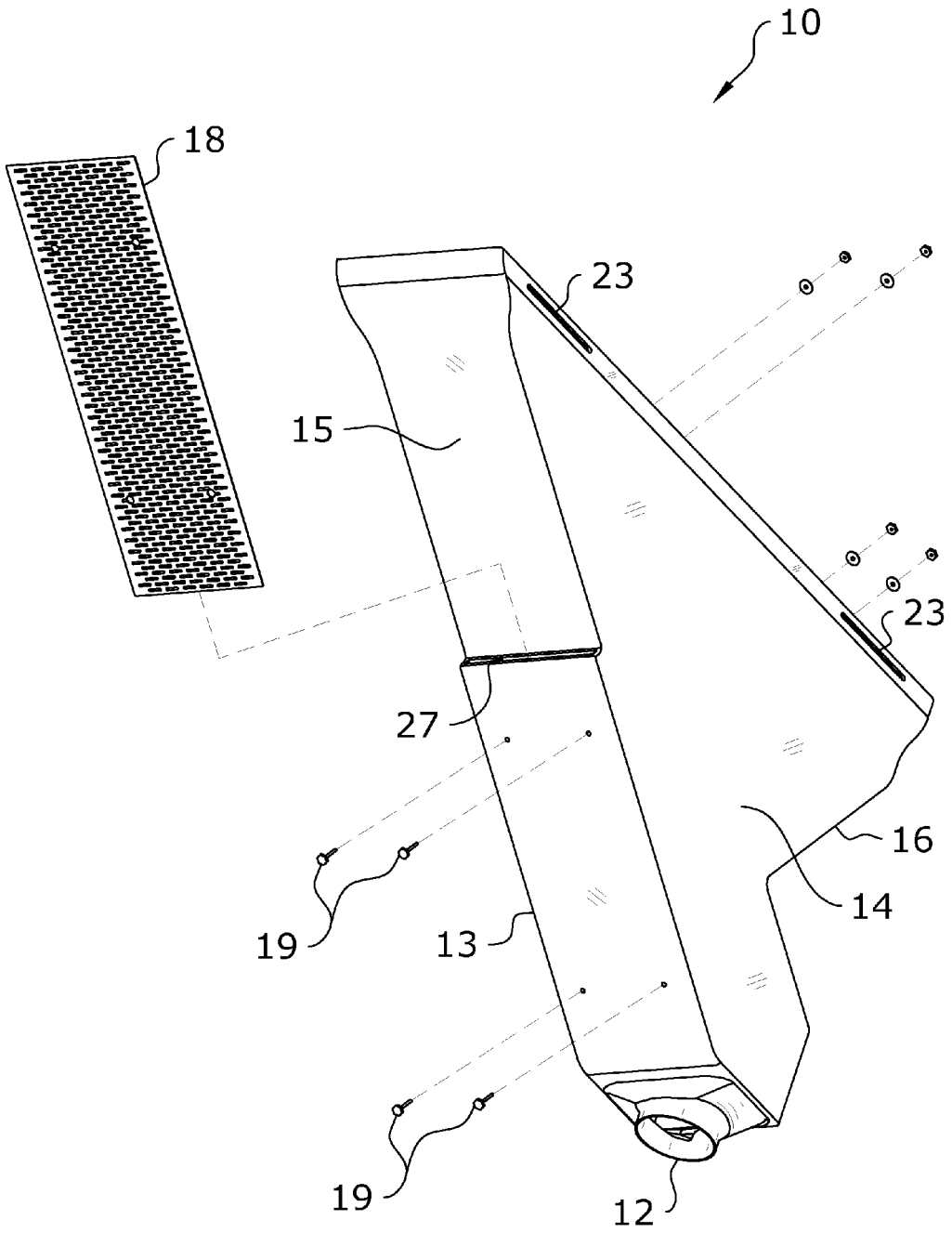
FIG. 2 is a lower perspective exploded view of the present invention.
Figure 3:
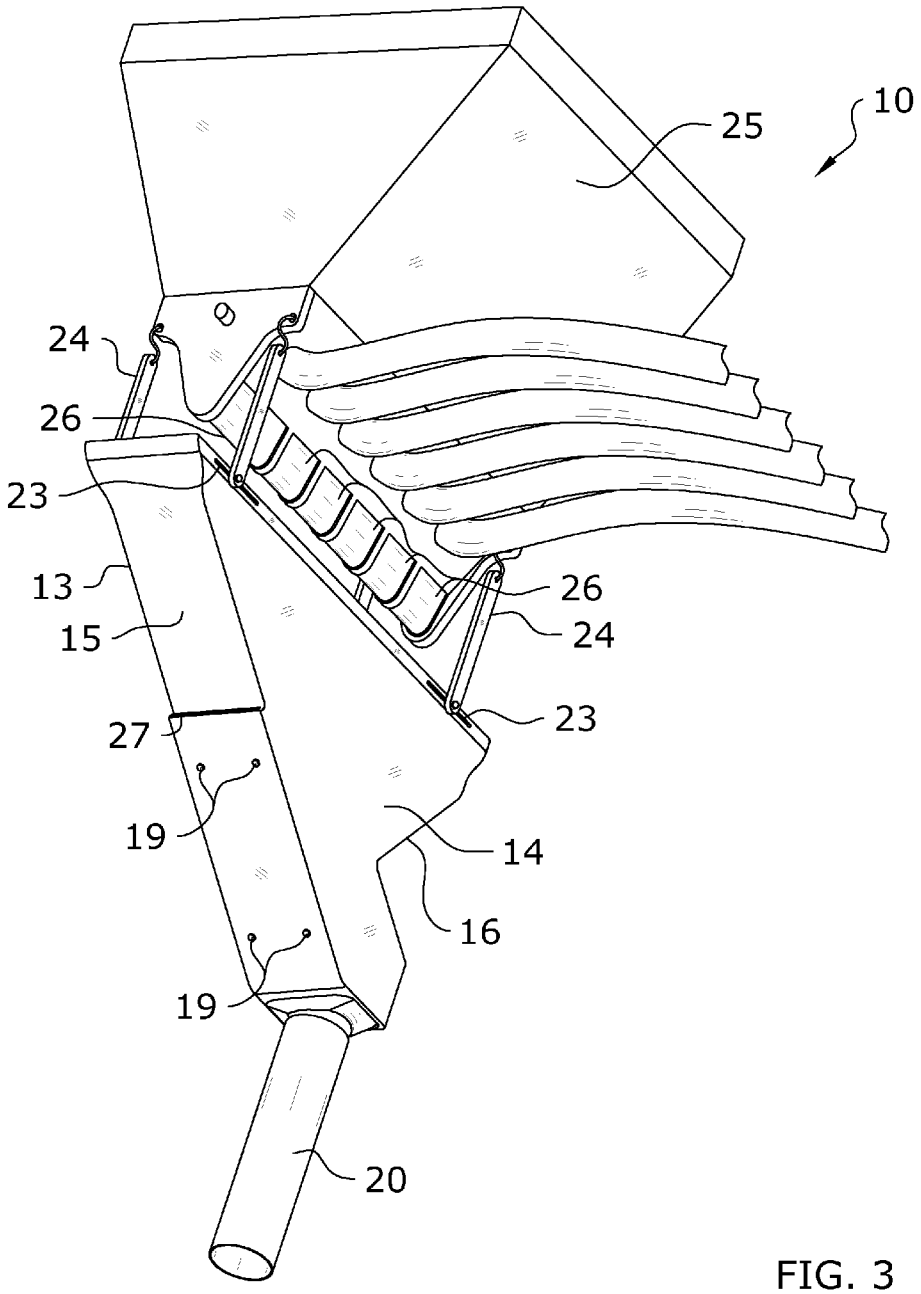
FIG. 3 is a lower perspective view of the present invention.
Figure 4:
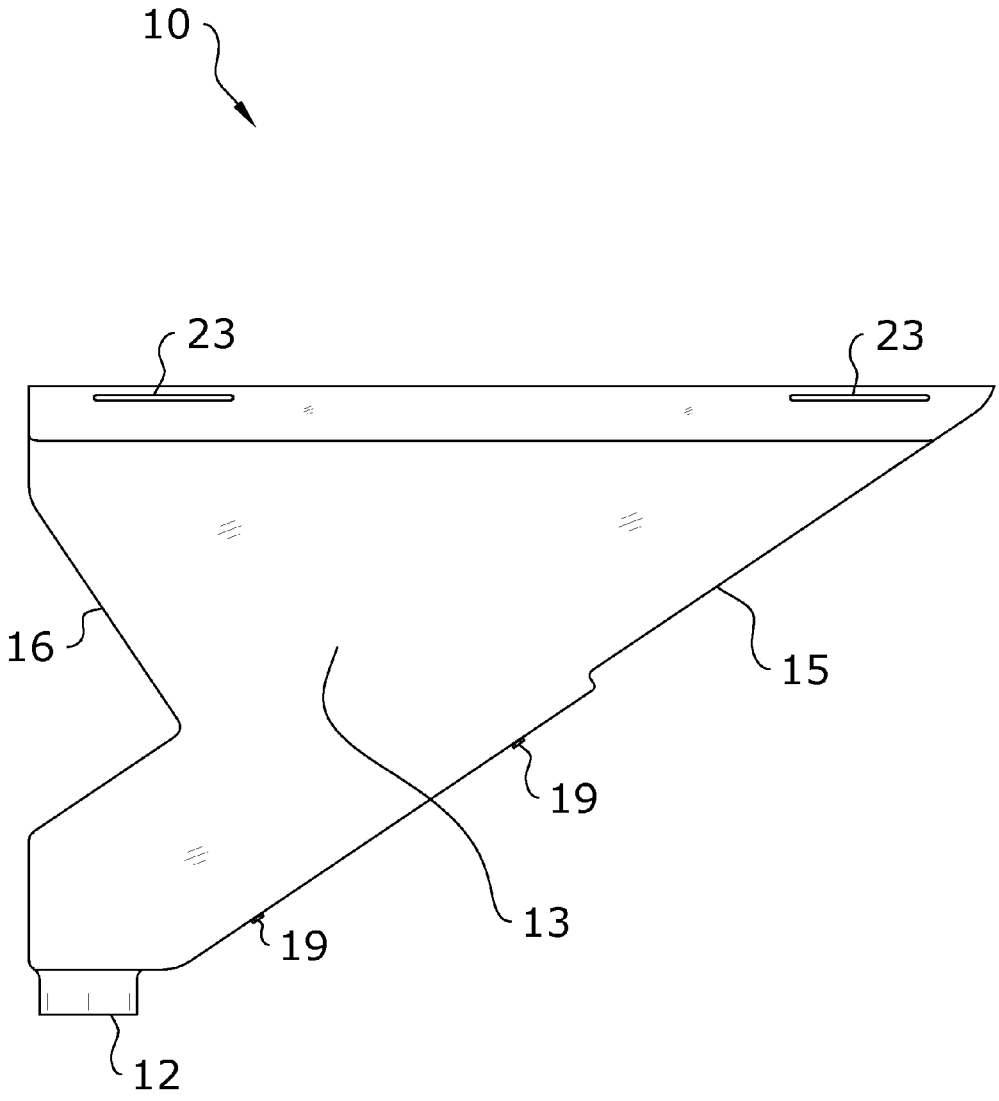
FIG. 4 is a side view of the present invention.
Figure 5:
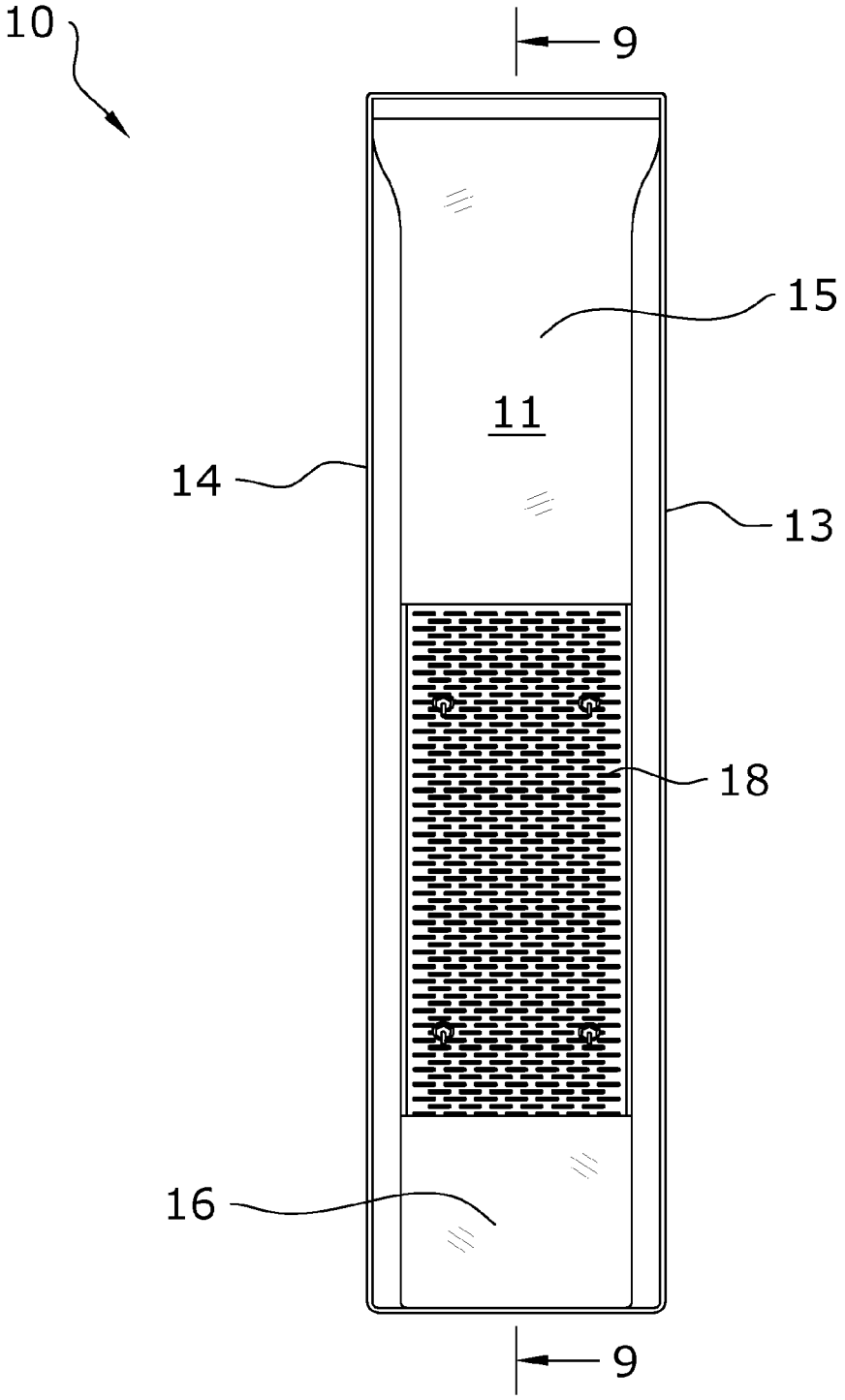
FIG. 5 is a top view of the present invention.
Figure 6:
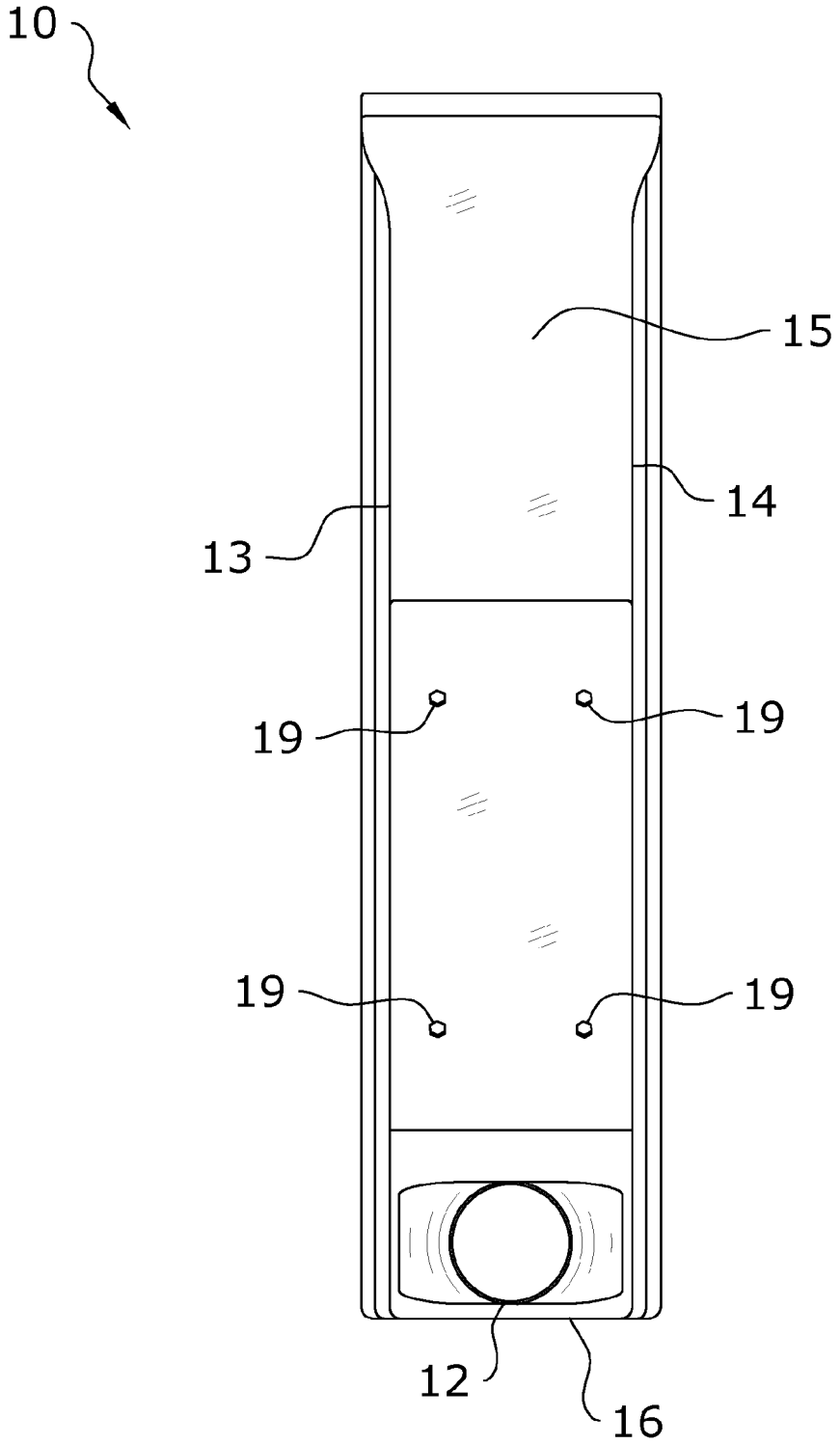
FIG. 6 is a bottom view of the present invention.
Figure 7:
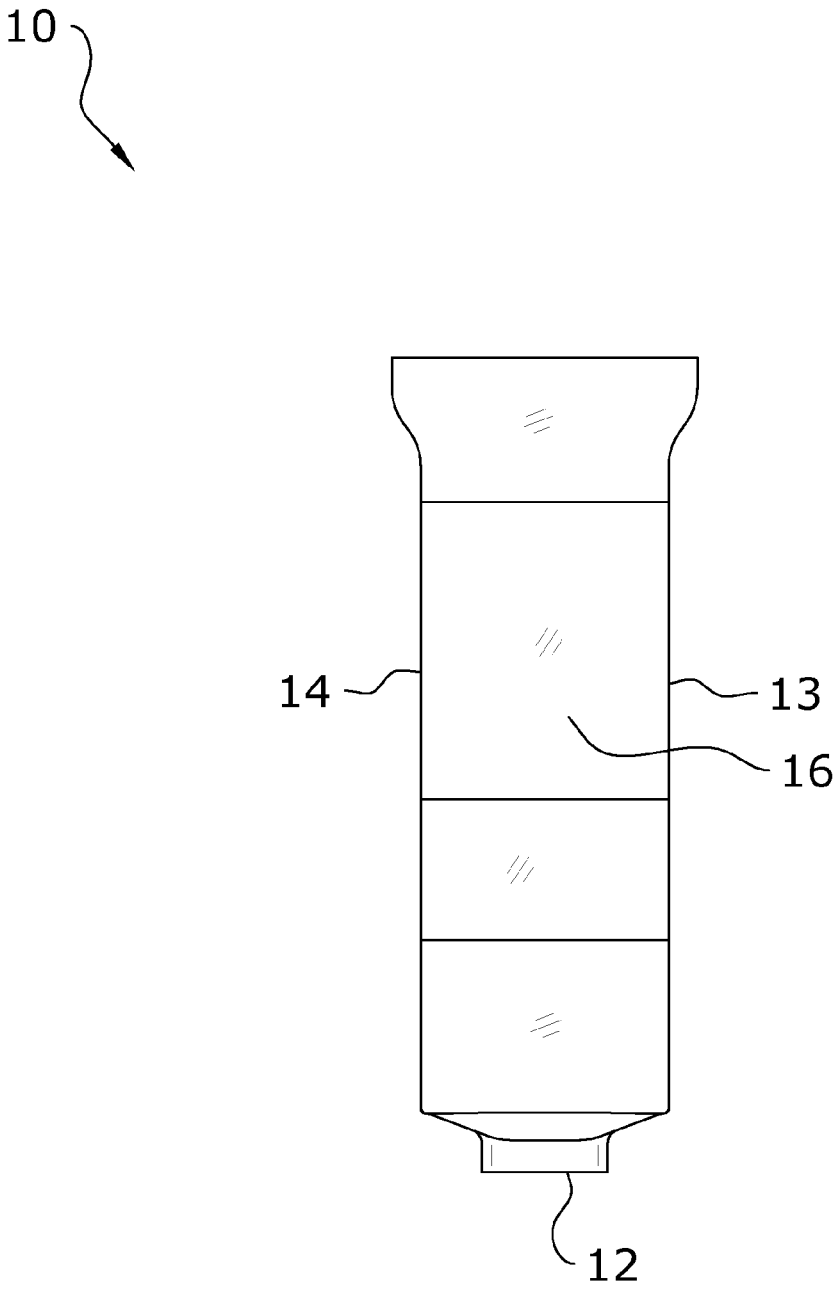
FIG. 7 is an end view of the present invention.
Figure 8:
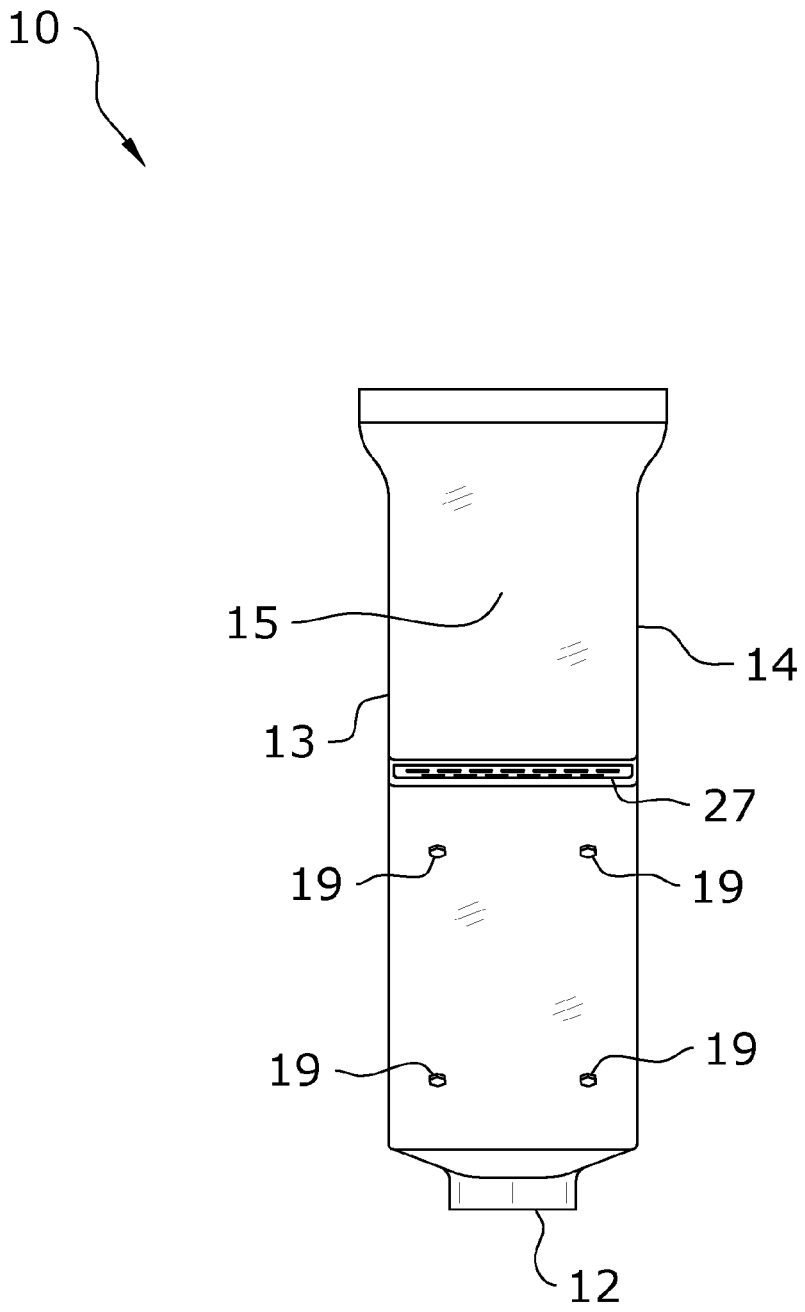
FIG. 8 is an end view of the present invention.

Turning now descriptively to the drawings, in which similar reference characters denote similar elements throughout the several views, FIGS. 1 through 11 illustrate a seed filtering system 10 (also referred herein as funneling device or device), which comprises, among other things, opening 11, discharge hole 12, side walls 13 and 14, primary wall 15, end wall 16, pocket 17, and filter 18.

As will be described in further detail herein, device 10 act as a funnel for material 21 that enters into opening 11 and exits via discharge hole 12. Additionally, the material flowing through device 10 is filtered of unwanted debris.

B. Opening and Discharge Hole

Device 10 includes opening 11 and discharge hole 12, such that material 21 funnels through device 10 from opening 11 to discharge hole 12.

C. Walls

Device 10 includes a plurality of walls to form a funnel-type structure, such as side wall 13, side wall 14, primary wall 15 and end wall 16.

Referring to at least FIGS. 1 and 5-8, side wall 13 and side wall 14 each extend from opening 11 to discharge hole 12. Moreover, side walls 13 and 14 are opposing walls that are parallel with one another.

Figure 9:
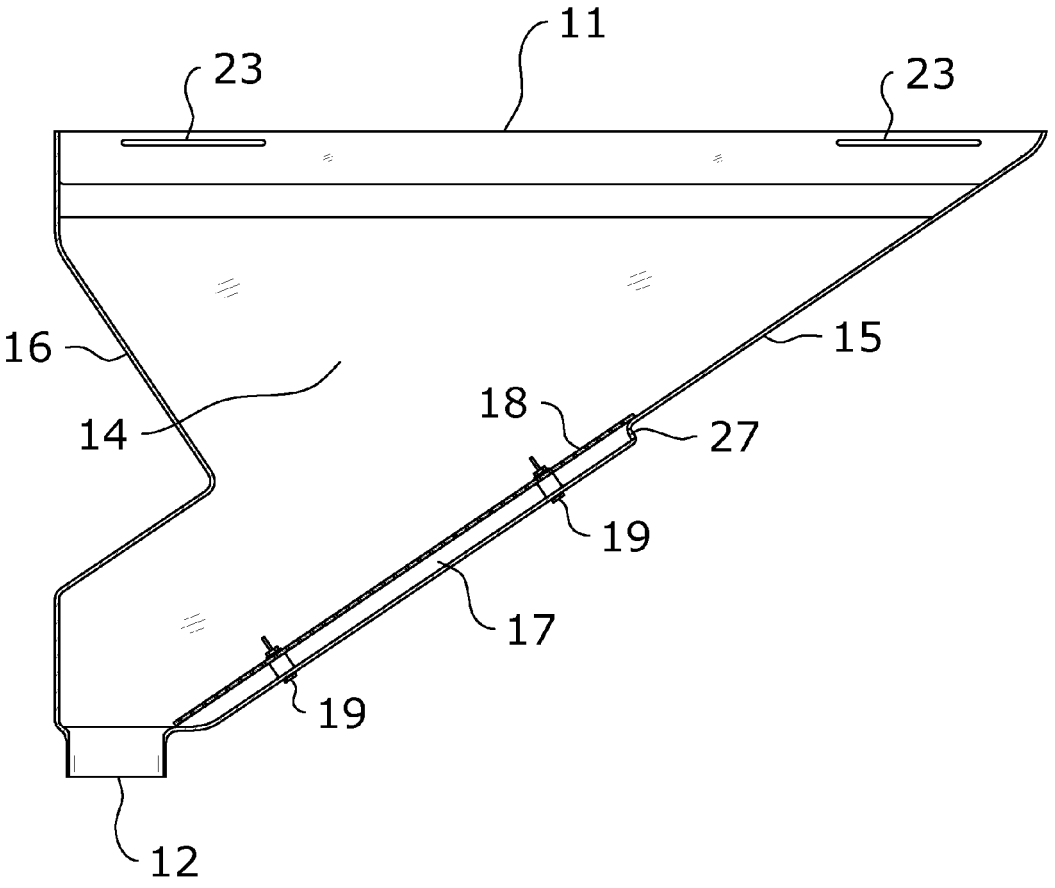
FIG. 9 is a cross-section of a side view of the present invention.
Figure 10:
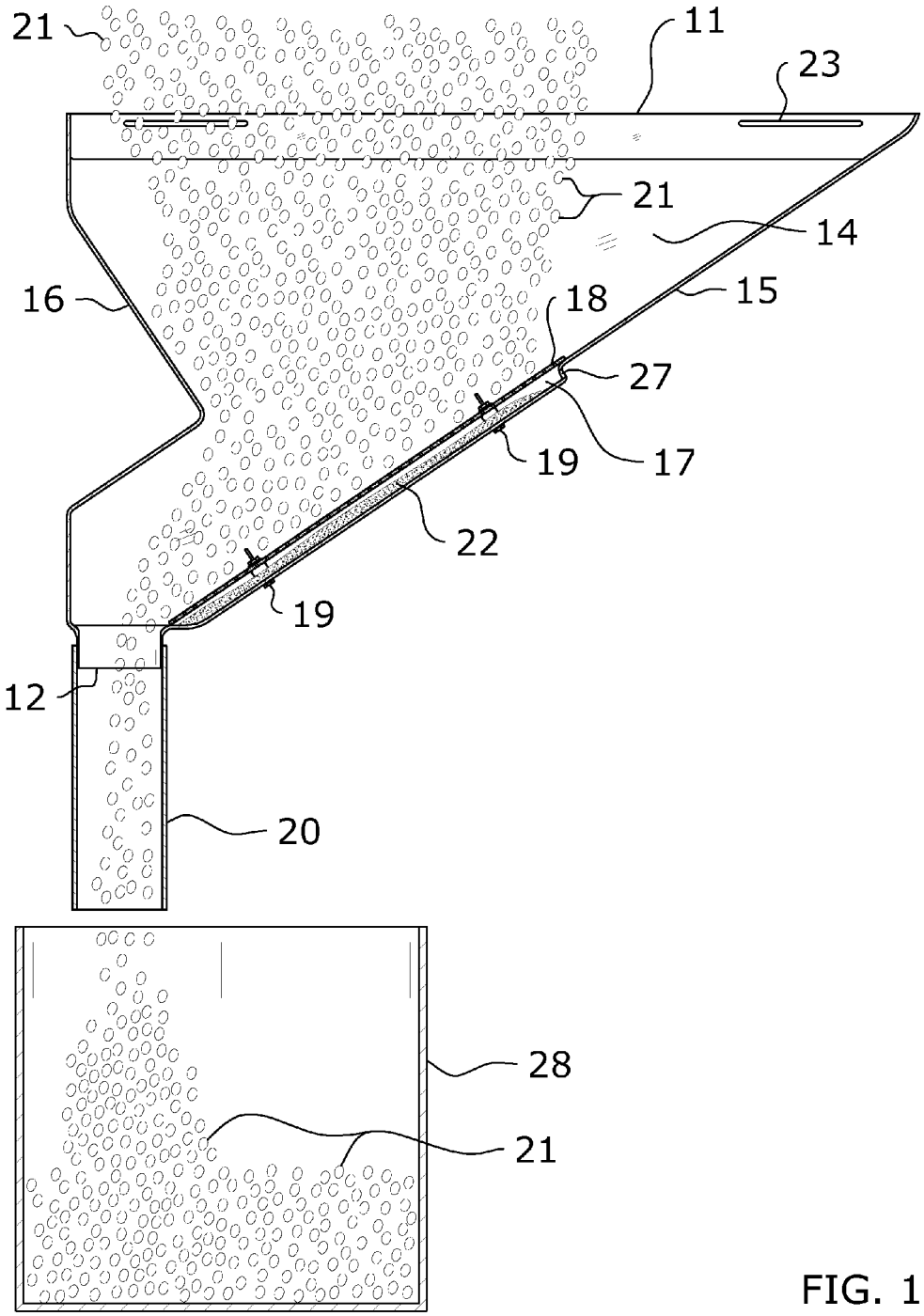
FIG. 10 is a cross-section of a side view of the present invention.

Referring to at least FIGS. 9 and 10, primary wall 15 is a sloped end wall that extends from opening 11 to discharge hole 12 along a first end of device 10. Additionally, end wall 16 extends from opening to discharge hole along a second end of device 10. It is noted that primary wall 15 and end wall 16 are opposing end walls that are joined with side walls 13 and 14.

As material 21 enters into opening 11, the material is funneled towards discharge hole 12 along primary wall 15. For example, the material either directly falls onto primary wall 15 and flows down to discharge hole 12 along primary wall 15 or the material deflects off of end wall 16 and subsequently falls onto primary wall 15. As a result, all of the material is funneled from opening 11 to discharge hole 12 along primary wall 15.

Walls of device 10, in one embodiment, are formed of plastic. In another embodiment, a side perspective of device 10 is substantially triangular in shape, for example as depicted in at least FIG. 4.

D. Filter

Device 10 includes filter 18. Filter 18 is for filtering out unwanted debris that is mixed in with material 21.

Filter 18 is attached to primary wall 15. In one embodiment, filter 18 is co-planar with primary wall 15. For example, the top surface of filter 18 is substantially co-planar with the inner surface of primary wall 15.

As material 21 flows along primary wall 15 towards discharge hole 12, the material passes over filter 18. Unwanted debris 22 of material 21 is then filtered out of the material before it exits device 10 at discharge hole 12.

In one embodiment, filter 18 is a screen material. More specifically, filter 18 includes a plurality of holes of one or more sizes. As material 21 flows over filter 18, any material having a size that is larger than the holes passes over filter 18 and any debris that is smaller than the plurality of holes of filter 18 falls through filter 18 into debris pocket 17. As a result, material 21 is filtered of unwanted debris as material 21 flows across filter 18.

E. Debris Pocket

Debris pocket 17 is disposed proximate filter 18. As described above, as material 21 flows over filter 18, debris 22 is filtered out of material 21 and collects in debris pocket 17.

Debris pocket 17, in one embodiment, is integral with primary wall 15. In particular, debris pocket is a feature of primary wall 15 and is not separable from primary wall 15.

Debris pocket 17, in another embodiment, is formed by filter 18 positioned over an indented feature of primary wall 15. As such, debris pocket 17 is a false floor with respect to primary wall 15.

Figure 11:
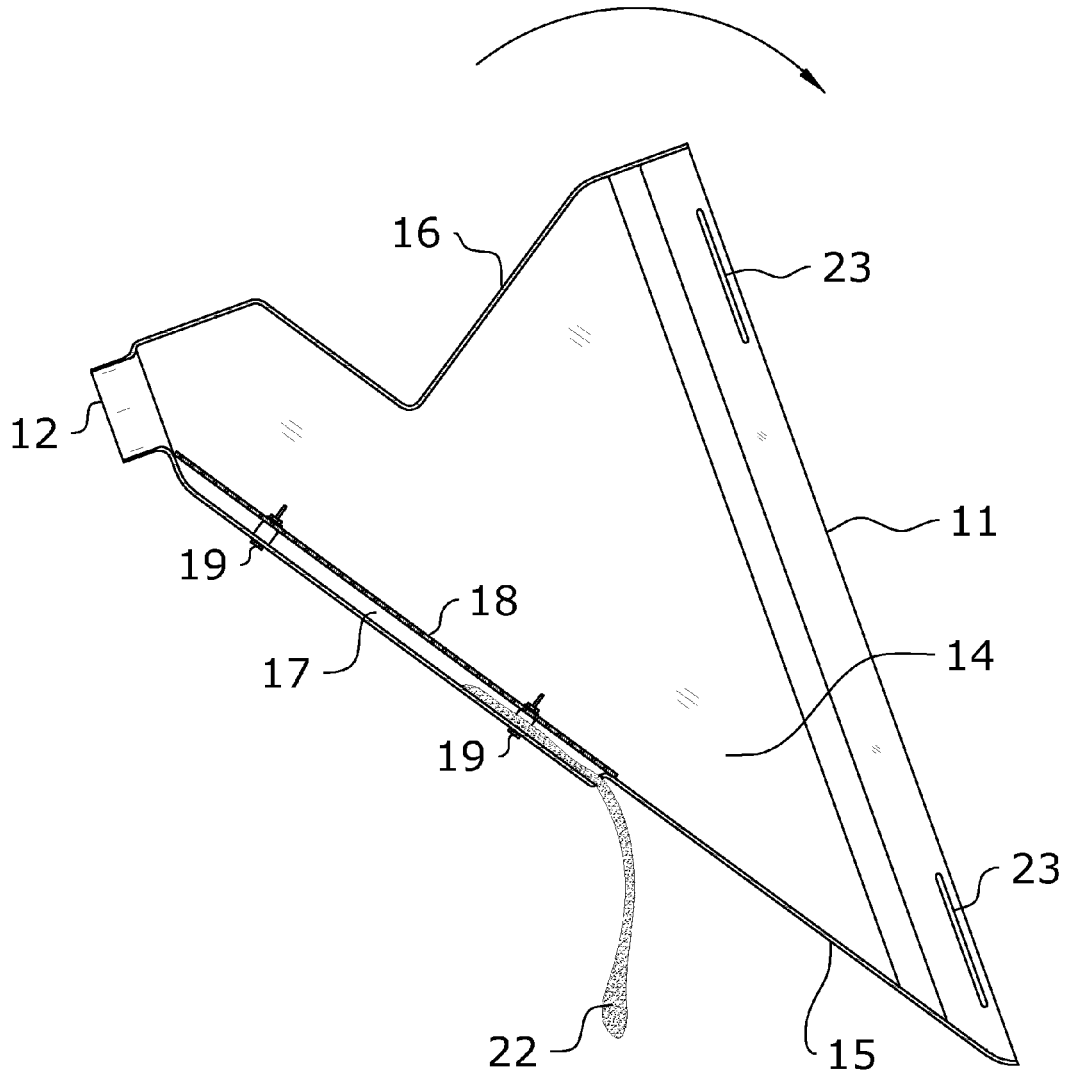
FIG. 11 is a cross-section of a side view of the present invention.

Debris pocket 17 includes opening 27. Opening 27 enables debris 22 to be discharged from debris pocket 17. Debris 22 is able to exit debris pocket 17 by rotating device 10 such that debris is able to flow out of opening 27, as depicted in FIG. 11.

Filter 18, in one embodiment, is attached inside of device 10 via retainers 19. For instance, retainers 19 attach filter 18 to debris pocket 17. Retainers 19 can be, but are not limited to, screws, nets, washers, etc.

F. Material

In one embodiment, material 21 that is funneled and filtered through device 10 is seed (e.g., corn seed). Material 21 can be any material that is able to funneled and filtered via device 10. Debris 22 that is filtered out of material 21 via filter 18, can be but is not limited to, chipped seed, excess talc and graphite, fines, etc.

G. Containers

Device 10 funnels material 21 that is transferred from a first container 25 to a second container 28 and also prevents spilling of material 21 as it is transferred. Additionally, material 21 may obtain debris 22 while it is stored in first container 25. As such, the debris may be filtered out of material 21 as it is transferred from first container 25 to second container 28.

In one embodiment, device 10 is positioned below first container 25 via attachment features 24 (e.g., straps). Attachment features 24 are attached to device 10 at slots 23 which are proximate opening 11. Attachment features 24, in one embodiment, each include a hook that are utilized to couple device 10 below first container 25, as depicted in at least FIG. 3.

First container 25 is any container that is able to hold or contain material 21. In one embodiment, first container 25 is a hopper, such as center fill hopper for use in planting seeds.

Second container 28 is any container that is able to hold or contain material 21 after it is transferred from first container 25. For example, second container 28 is a storage container for proper storage of seeds.

Material 21 may be discharged from first container 25 via ports 26. The material may be discharged from ports 26 individually or concurrently. As ports 26 are opened, material 21 is discharged into opening 11 of device 10. Material 21 is the funneled and filtered through device 10, as described herein.

The filtered material then exits device 10 at discharge hole 12 into second container 28. In one embodiment, tube 20 is attached to discharge hole 12 to facilitate in directing the material into container 28.

H. Operation of Preferred Embodiment

In use, device 10 funnels and filters material 21 as the material passes through device 10. Additionally, device 10 helps prevent spillage of material 21 as material 21 is transferred from first container 25 to second container 28.

Material 21 enters device 10 at opening 11. For example, the material pours out of first container into opening 11.

Material 21 then travels along primary wall 15 towards discharge hole 12. As material 21 is funneled through device 10, material flows across filter 18. Debris 22 in material 21 is filtered out of material 21 and the debris falls into debris pocket 17. As a result, material 21 is filtered of unwanted debris as it is funneled through device 10. Moreover, spillage or waste of the material is reduced or eliminated during the transfer of the material from first container 25 to second container 28. Additionally, debris 22 may be subsequently removed from debris pocket 17 via opening 27. In particular, device 10 is rotated such that debris 22 falls out of debris pocket 17 (see at least FIG. 11).

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A funneling device comprising:

an opening for receiving material entering into said funneling device;

a primary side wall, wherein all of said material entering said funneling device is funneled onto said primary side wall;

a filter disposed on said primary side wall for filtering said material that is funneled onto said primary side wall;

a pocket connected to said primary side wall for catching debris filtered from said material; and a discharge hole for discharging said material that is filtered through said funneling device.

2. The funneling device of claim 1, wherein said filter comprises:

a screen.

3. The funneling device of claim 1, wherein said pocket comprises:

an opening for discharging said debris from said pocket.

4. The funneling device of claim 1, wherein said pocket is integral with said primary side wall.

5. The funneling device of claim 1, further comprising:

attachment features for attaching said funneling device below a first container containing said material.

6. The funneling device of claim 5, wherein said attachment features comprises:

a plurality of straps.

7. The funneling device of claim 5, wherein said first container is center fill hopper.

8. The funneling device of claim 1, further comprising:

a discharge tube coupled to said discharge hole for directing said filtered material to a second container.

9. The funneling device of claim 1, wherein said material is seed.

10. A seed catching device comprising:

an opening for receiving seed entering into said seed catching device;

a primary side wall, wherein all of said seed entering said opening is funneled onto said primary side wall;

a pocket for catching debris filtered from said seed, wherein said pocket is integral with said primary side wall; and a filter disposed on said primary side wall for filtering out debris from said seed that is funneled onto said primary side wall.

11. The seed catching device of claim 10, wherein said pocket comprises:

an opening for discharging said debris from said pocket.

12. The seed catching device of claim 10, wherein said filter comprises:

a screen.

13. The seed catching device of claim 10, further comprising:

a discharge hole for discharging said seed from said seed catching device.

14. The seed catching device of claim 10, further comprising:

attachment features for attaching said seed catching device below a first container.

15. The seed catching device of claim 14, wherein said attachment features comprises:

a plurality of straps.

16. The seed catching device of claim 14, wherein said first container is center fill hopper.

17. The seed catching device of claim 10, further comprising:

a discharge tube coupled to a primary discharge hole for directing seeds into to a second container.

* * * * *